United States Patent [19]

Hosey et al.

[11] Patent Number: 4,583,311

[45] Date of Patent: Apr. 22, 1986

[54] COMBINED CHANGEABLE SIGN ASSEMBLY

[75] Inventors: Richard E. Hosey, Pedro, Ohio; Ervan E. Rich, Florence, Ky.

[73] Assignee: Ashland Oil, Inc., Ashland, Ky.

[21] Appl. No.: 704,108

[22] Filed: Feb. 21, 1985

[51] Int. Cl.[4] ..... G09F 7/02

[52] U.S. Cl. ..... 40/611; 40/606; 40/605

[58] Field of Search ..... 40/10, 584, 605, 606, 40/617, 611

[56] References Cited

U.S. PATENT DOCUMENTS

| | | | |
|---|---|---|---|
| 2,865,124 | 12/1958 | Mortellito | 40/605 |
| 3,015,899 | 1/1962 | Ensign et al. | 40/611 |
| 3,132,431 | 5/1964 | Petrie | 40/611 |
| 3,978,631 | 9/1976 | Diersing | 40/605 |
| 4,030,219 | 6/1976 | Donovan | 40/611 |
| 4,144,664 | 3/1979 | De Korte | 40/610 |
| 4,300,299 | 11/1981 | Batky | 40/10 R |

*Primary Examiner*—Gene Mancene
*Assistant Examiner*—Wenceslao J. Contreras
*Attorney, Agent, or Firm*—Richard C. Willson, Jr.; Donald E. Zinn

[57] ABSTRACT

A pair of horizontally-spaced vertically upright facing channel members are fixably mounted to an underlying horizontal support. An elongated planar base member has longitudinally spaced holes receiving the vertically upright facing channel members and rests on the horizontal support. Brackets affixed to the inside faces of the channel members mount an elongated planar cap member may be identical to and the mirror image of the planar base member at a vertically spaced position above the base member, being slidably lowered on the channel members, through the longitudinally spaced holes therein. A first endless loop sign is positioned in an axially upright position with its edges in vertical grooves near the peripheries of the base and cap members and sandwiched therebetween to form a first visual display. A placard holding frame assembly sized to facing channel members is slidably mounted within the facing channel members with its lower end mounted to the cap member thereby forming a dual element changeable display.

6 Claims, 3 Drawing Figures

COMBINED CHANGEABLE SIGN ASSEMBLY

FIELD OF THE INVENTION

This invention relates to display assemblies for mounting removable display placards in vertical upright position on top of gas pumps, and more particularly to a simplified display assembly for displaying information by way of a second changeable loop form sign in addition to that of the vertical upright placard.

BACKGROUND OF THE INVENTION

Display assemblies for supporting removable display placards are frequently used by service stations to advertise various products and are mounted directly to and atop a gas pump where they immediately confront the service station customer. This is particularly true for the so-called convience service stations specializing in self-service. Since the vertical display placard offers considerable wind resistance, such display assemblies must have a high degree of rigidity without compromising the ability to quickly change the display placard. Where, it is desirable to incorporate a further changeable display sign in addition to the placard, the strength and resistance of the display assembly to wind distortion and structural complexity is increased.

It is therefore an object of the present invention to provide a simplified, relatively inexpensive dual element display assembly for holding a removable display placard which is integrated with a second loop form display sign underlying the base and generally conforming to the size of the horizontal support surface bearing the display assembly.

SUMMARY OF THE INVENTION

A combined dual placard and loop sign changeable display assembly for mounting to an underlying generally horizontal support member comprises a pair of horizontally spaced, in line, vertically upright open facing channel members for fixably mounting to said underlying support member, a pair of elongated planar base and cap members. Means are produced for mounting said base member and said cap member to and between said upright channel members at spaced vertical positions. A first display member preferably of endless loop form in axially upright position surround said pair of facing channel members and is in edge abutment with and mounted between said base and cap members at the bottom and top edges of said first display member, respectively. A placard holding frame assembly sized to and vertically mounted within said facing channel members includes a vertical upright placard, or multiple replaceable back to back sheets, with the lower edge of said placard holding frame assembly in juxtaposition with said cap member to complete a double element changeable display.

The planar base and cap members may comprise elongated members of a length in excess of the distance between the vertical upright facing channel members. The planar base and cap members may carry longitudinally spaced, aligned holes sized in excess of the upright channel members with said channel members passing therethrough. Vertical grooves maybe provided within the facing surfaces of the base and cap member of a width corresponding to the thickness of the first display member of endless loop form sized and being configured to the first display member to receive the top and bottom edges thereof for stably supporting the first display member sandwiched between the planar base and cap members. A pair of brackets may be fixed respectively on the facing sides of said upright channel members at a given position above the planar base member and said cap member is fixably mounted to said brackets. An upwardly opened, U-shaped channel member may be fixably mounted to the upper surface of the cap member, extending between and in line with the horizontally spaced, vertically upright, facing channel members for receiving the bottom edge of the placard holding frame assembly.

DESCRIPTION OF THE PREFERRED EMBODIMENT

Figure 1:
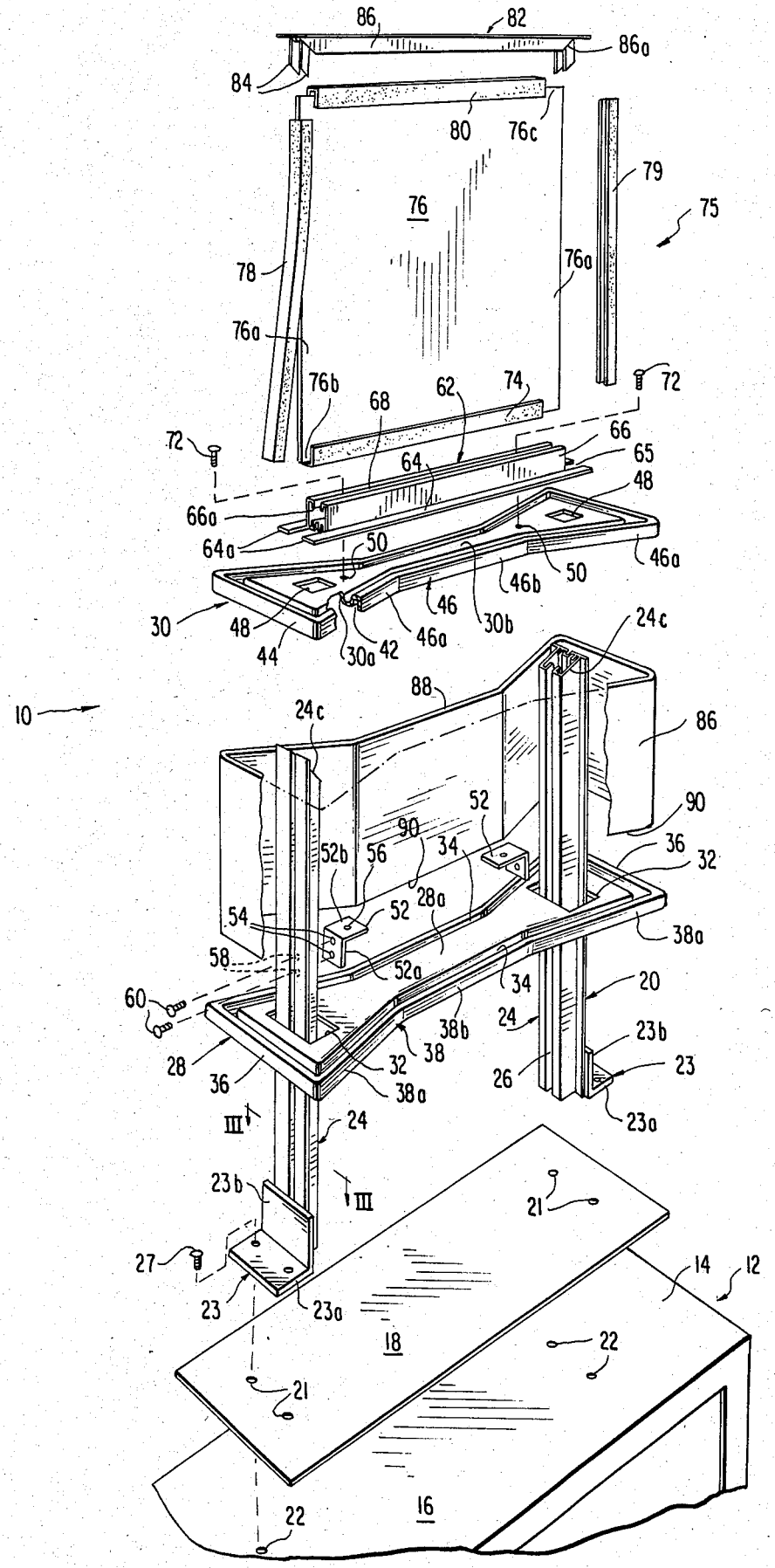
FIG. 1 is an exploded perspective view of the combined, dual placard and loop sign changeable display assembly forming a preferred embodiment of the present invention.

Referring to the drawings, the combined, dual placard and loop sign, changeable display assembly embodying a preferred form of the invention, is designated generally at 10. It is adapted to be mounted on the top of a gas pump 12. Specifically the gas pump 12 has an exterior, generally rectangular block form casing or housing 14 including a generally horizontal top wall 16 acting as an underlying support for the display assembly 10. All that is necessary to mount the display assembly 10 to the top wall 16 of the gas pump housing is to drill, two pairs of laterally spaced and longitudinally aligned holes as at 22 within the top 16. As seen in FIG. 1, the location of the holes 22 are defined by a template 18 in the form of a paper or cardboard sheet within which are provided holes as at 21 corresponding to the locating of holes 22 to be drilled within the housing top wall 16 of the gas pump 12. Once the holes 22 are drilled at the desired locations utilizing template 18, the template may be discarded.

Turning to the display assembly 10, it is principally formed by a pair of oppositely directed, U-shaped metal channel members indicated generally at 20 consisting of vertically upright channel bars 24, riveted, welded or otherwise affixed to vertical upright portions **23*b* of angles or brackets 23. The brackets each include a right angle horizontal base portion 23*a* which, receives sheet metal self-tapping screws 27 which penetrate and are threadably received by holes 22 within the gas pump housing 14. The U-shaped metal channel members 20 are mounted such that, openings or slots 26 within channel bars 24, formed by laterally spaced sidewalls 24*b* which project outwardly of planar base portions or rear walls 24*a* form the slot 26 of a width loosely receiving the sides of placard assembly 75. It should be noted, that the upper ends of the channel bars 24 are obliquely cut as at 24*c* in the form of a miter cut to cooperate with mitered ends of a top channel member indicated generally at 82 when the ends of top channel member 82** is mounted thereto.

Important to the creation of a combined dual placard and loop sign display assembly 10, are the utilization of generally matching planar base member 28 and planar cap member 30. Base member 28 which may be formed of molded plastic, sheet metal or the like is bow-shaped in plan configuration in the illustrated embodiment although, members 28 and 30 may take other configurations. The base member 28 is provided with a pair of rectangular openings or holes 32 within the laterally enlarged ends of the base member 28. These holes are of a width and length so as to slidably receive the channel bars 24 of channel members 20 and when the base member is lowered as shown in FIG. 1, the holes 32 pass down and over the vertical upright portions 23*b* of angles 23 such that, the base member 28 rests directly on the surface top wall 16 of the gas pump housing 14. The base member 28 is provided with longitudinally opposed end faces 36, while sides indicated generally at 38 are comprised of straight parallel center portions 38*b* joined to oblique side portions 38*a*, to each side thereof, diverging in the direction of the end faces 36 of the base member 28. Further, completely about the circumference of the base member 28, within the upper face 28*a*, is a vertical groove 34 adapted to receive the lower edge 90 of a loop form rigid sheet plastic topper face 86 which is configured to the bow-shaped configuration of groove 34 within the upper face 28*a* of base member 28.

To effect the assembly and maintenance in position of the topper face 86, assembly 10 is provided with a means for mounting the cap member 30 at a predetermined vertically spaced position above the base member 28 and fixedly coupled to the U-shaped metal channel members 20.

As best seen in FIG. 1, the cap member 30 which may be formed of molded plastic or sheet metal and identical to the base member 28, with the exception of the size of a pair of rectangular holes 48 therein. The cap member has similar sized, flat ends faces 44 as well as sides indicated generally at 46 to that of base member 28, formed by straight, opposed and parallel center sections 46*b* integrated to outwardly diverging side portions 46*a* in the direction of end faces 44 of the cap member. The cap member is a mirror image to the base member 28 in that it includes a vertical groove 42 as indicated in dotted lines FIG. 1 within the lower face 30*a* of cap member 30 about the periphery, following the bow-shaped configuration of the cap member. The rectangular holes 48 are of a width equal to the width of the channel bars 24 and of a length generally equal to the cross-sectional thickness of those members, and the distance between the holes 48 is such that the holes 48 closely receive the upper ends of the channel bars 24 when, as shown in FIG. 1, the cap member 30 is lowered onto the top of the loop form, sheet plastic topper face 86. As such, the upper edge 88 of the topper face is received within the groove 42 so that the bow-shaped configuration of the topper face matches that of the base member 28 and the cap member 30 and is rigidly maintained between these two members, which sandwich the topper face 86 therebetween.

As mentioned previously, the cap member 30 is fixedly mounted to the channel bars 24 at some distance above the angles 23. A pair of angles or brackets 52 of sheet metal, including right angle vertical portions 52*a* and horizontal portions 52*b*, function to support and maintain the cap member 30 in horizontal position and parallel to the bow-shaped base member 28. The vertical portions 52*a* of the angles 52 bear a pair of holes at 54 which receive mounting bolts or self-tapping screws 60 after passing through holes 58 within the base 24*a* of respective channel bars 24. Additionally, the horizontal portion 52*b* of the angles 52 include a single hole 56 at the center thereof which aligns with a respective hole 50, within cap member 50, within cap member 50; holes 50 and 56 receiving self-tapping metal screws or bolts 72.

The mounting screws or bolts 72 perform a dual function. They allow the cap member 30 to be fixedly mounted by bolts or screws to the channel bars 24 of the U-shaped metal channel members 20 while additionally, they function to locate and fixedly mount a horizontal placard support channel member 62 to the top surface 30*b* of cap member 30 and between the longitudinally spaced channel bars 24 of assembly 10. The placard support channel member 62 includes a horizontal sheet metal base portion 64 from which integrally, and upwardly rise laterally spaced sidewalls 66. The ends of the sidewalls are being bent over at 66*a* to form a narrow elongated horizontal slot 68 which receives the lower edge of placard assembly 75. Further, the sidewalls 66 of the horizontal placard support channel member 62 are shorter than base 64 and base 64 is cutout at its center for form short strips 64*a* to each side of slots 65 which slots, receive vertical upright channel bars 24 to facilitate the rigid connection and mount of the placard assembly 75 to the underlying topper face support components constituted by cap member 30 and base member 28. Holes drilled within base 64 of the horizontal placard support channel member 62 (not shown) permit the mounting screws or bolts 72 to pass therethrough prior to passing downwardly through holes 50 within the underlying cap member 30, FIG. 1, for locking of the cap member 30 to the angles 52 and the horizontal placard support channel member 62 to the upper face 30*b* of the cap member 30. It should be kept in mind that the screws or bolts 72 must be tightened and set to a position within the channel slot 68 to a degree sufficient to allow the placard assembly 75 at its lower end to pass therethrough and to fall completely into place within channel member slot 68.

The placard assembly 75 constituting the second of the dual changeable sign components of assembly 10, is comprised of a rectangular Styrofoam placard 76. Alternatively, the placard 76 may be replaced by dual, back to back clear, translucent, or opaque sheets or cards. Preferably, four plastic, U-shaped extrusions are applied to the four edges of the placard 76 prior to mounting to the horizontal placard suport channel member 62 at its lower edge 76*b*, and with its side edges at 76*a* slid into slot 26 of channel members 24 to the extent permitted by the horizontal cap member 30 which bridges between those members. Specifically, a pair of plastic side extrusions 78, 79 are snapped onto the side edges 76*a* of the placard 76. A bottom plastic extrusion 74 is snapped onto the lower edge 76*b* of the Styrofoam placard 76 while, an upper plastic extrusion 80 is snapped onto placard 76 at its upper edge 76*c*. The placard assembly 75 is of a vertical height generally equal to the distance between the top surface 30*b* of the cap member 30 and the beveled ends 24*c* of the channel bars 24 of channel members 20 while, the lateral width of the placard assembly 75 is slightly less than the distance between backs or bases 24*a* of vertical upright channel bars 24 within whose sidewalls 24*b*, the placard assembly 75 is slid, to effect the mounting of the placard 76 channel members 20.

Figure 3:
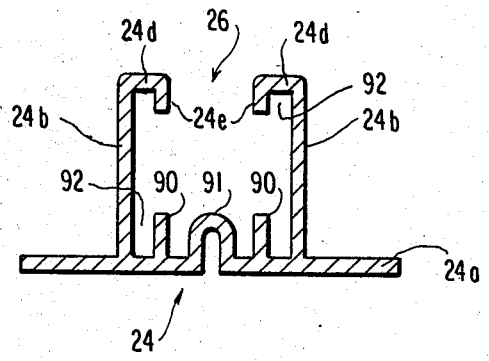
FIG. 3 is a transverse sectional view of a channel bar extrusion of FIG. 1, taken about lines III, III.

It is important to note that preferably, the channel bars 24, the horizontal placard support channel member 62, and top channel member 82 are of identical cross-sectional size and configuration and formed of the same light weight metal extrusion stock material, such as aluminum. In that respect therefore, as seen in FIG. 3, for channel bars 24, sidewalls 24*b*, remote from the back or base 24 are bent over and back to form front face portions as at 24*d*, and terminate in reversely or rearwardly bent portions 24*e* which face each other and define slot 26. Additionally, the back or base 24 internally and between sidewalls 24*b* are provided with two short height projection strips as at 90, which are aligned with the reversely bent sidewall terminal portions 24*e*. As such, they form, with the sidewalls 24*b* of the channel bars 24, narrow vertical slots as at 92 which function to receive, respectively, one of paired prongs 84 at opposite ends of the top channel member extrusion 82. Back of base 24*a* of channel bar 24 is also provided with a central projection 91, internally, facing slot 26 as a backup for the side edges of placard assembly 75 as it is slid downwardly within slots 26 of channel bars 24. FIG. 1 shows horizontal placard support channel member 62 as including internally and between laterally spaced sidewalls 66, a pair of laterally spaced, upright strips or projections 63 and an upright projection 67 centered therebetween on which is positioned the lower edge of the placard assembly 75 when the placard is slid downwardly between sidewalls 66 of that channel member and within slot 68. Further, the side edges of the placard assembly 75 are maintained in contact with center strip projections 91 of the vertical upright channel bars 24.

The assembly 10 is completed by fitting the top channel member 82 across the top of the placard assembly 75 and spanning between and connected to the upper ends of channel bars 24. The pair of prongs 84, at each end of the channel member 86, fit into slots 92 and between sidewalls 24*b* of the channel members 24 and strip projections 90 with mitered edges 24*c* of the channel members meeting and contacting the oblique, miter edges 86*a* of sidewalls 86 to the top channel member 82. The connection between these members and the fitting of the top plastic extrusion 80 into the U-shaped top channel member 82, which opens downwardly, assures a rigid connection and coupling of the placard assembly 75 to the display assembly 10 proper. The horizontal placard support channel member 62, the upper ends of the channel bars 24 and the top channel member 82 form four right angle frame components securing the placard 76 in place.

Figure 2:
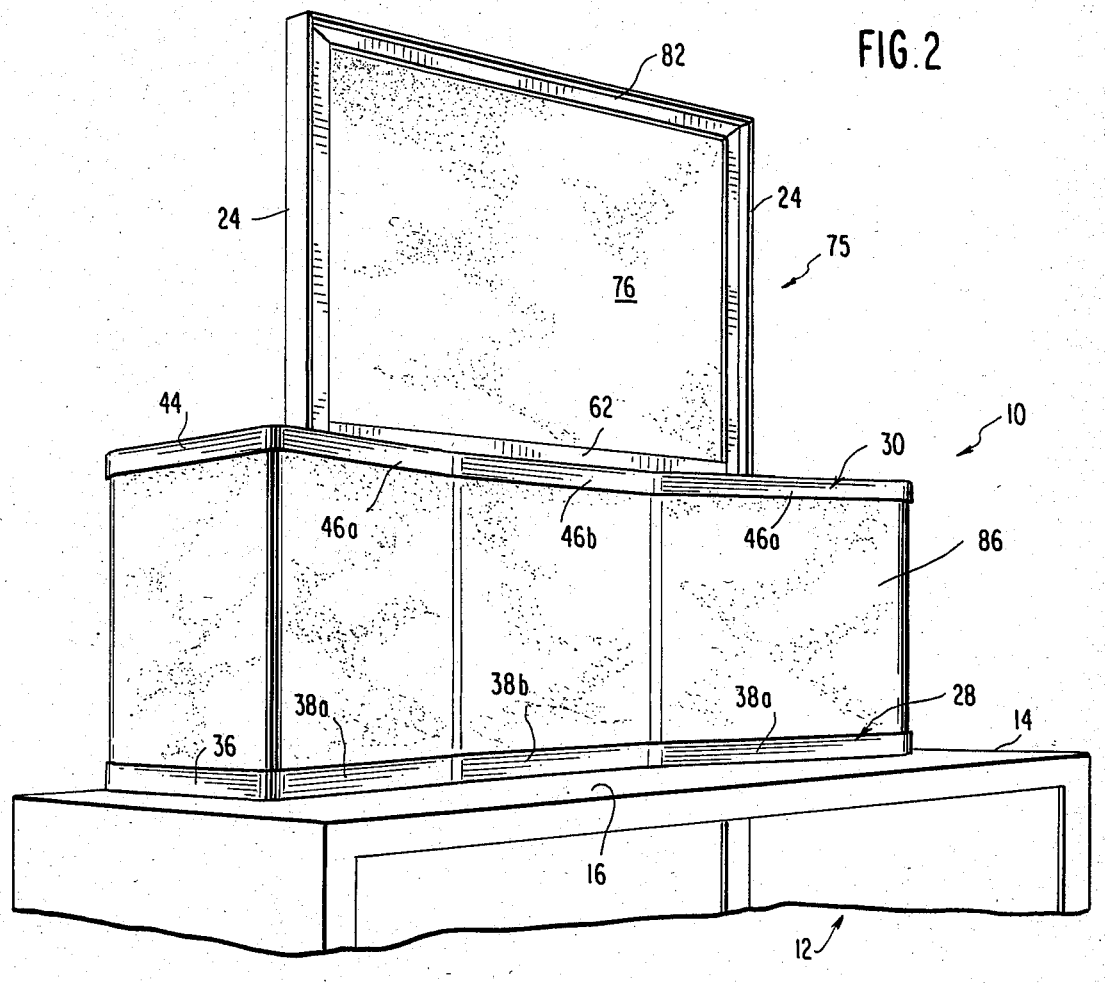
FIG. 2 is a perspective view of the assembly of FIG. 1, mounted to the top of a gas pump.

It is apparent from the above description and as seen in FIGS. 1 and 2 that the components are simple and well adapted to the creation of a dual purpose, two part sign in which the placard assembly 75 is easily lifted from the channel member slots receiving the sides and bottom thereof to effect replacement of the placard. While, some disassembly is required, i.e., the removal of screws or bolts 72 to permit replacement or change of the sheet plastic topper face 86, both changes may be made in a slot. The components may be formed of metal and plastic with the metal components preferably made of aluminum for strength while being of light weight to minimize handling and ease of installation. While the base member 28 and the cap member 30 may constitute stamped metal plates such as aluminum, they are preferably formed of molded plastic. Further, while in plan configuration both of these components are bow-shaped as well as that of the sheet plastic topper face in loop form which matches the slot or groove 34 within base members 28 and that of 42 within cap member 30, respectively, at its lower and upper edges of that sign component, these members may be rectangular, of even width throughout their length, or they could be oval or of other appropriate configuration.

While there has been described what is at present considered to be the preferred embodiment of this invention, it will be obvious to those skilled in the art that various changes and modifications can be made therein without departing from the invention, and it is, therefore, intended to cover all such changes and modifications as fall within the true spirit and scope of the invention.

What is claimed is:

1. A combined dual placard and looped sign changeable display assembly for mounting to an underlying and generally horizontal support member, said assembly comprising:

a pair of horizontally spaced, in line, vertically upright open facing channel members for fixedly mounting to said underlying support member, a pair of elongated planar base and cap members, a means for mounting said base member and said cap member to and between said upright channel members at spaced vertical positions with the base member underlying said cap member, a first upright display member of endless loop form surrounding said pair of facing channel members and being in edge abutment with and maintained between said base and cap members, a placard holding frame assembly sized to and vertically mounted at opposed sides within said facing channel members, said placard holding frame assembly including a vertical upright placard and said placard holding frame assembly having its lower edge in juxtaposition with said cap member and extending the top of the cap member to complete a double element changeable display.

2. The changeable display assembly as claimed in claim 1, wherein said planar base and cap members comprise elongated members of a length in excess of the distance between the vertical upright facing channel members, and said planar base and cap members carrying longitudinally spaced, aligned holes sized in excess of the upright channel members with said channel members passing respectively therethrough and closely received thereby.

3. The changeable display assembly as claimed in claim 1, wherein the facing surfaces of the base and cap member include vertical grooves about the peripheries of said base and cap members having a width corresponding generally to the thickness of said first display member of endless loop form with the upper and lower edges of said first display member being received within respective vertical grooves for stably supporting and rigidly connecting said first display member to said planar base and cap members and being sandwiched therebetween.

4. The changeable display assembly as claimed in claim 1, wherein a pair of brackets are affixed respectively on facing sides of said upright channel members at a given position above the planar base member and said cap member is fixedly mounted to said brackets at opposite ends thereof.

5. The changeable display assembly as claimed in claim 1, further comprising an upwardly open, U-shaped horizontal placard support channel member fixedly mounted to the upper surface of the cap member and extending between and in line with the horizontally spaced, vertically upright facing channel members and including a slot receiving the bottom edge of the placard holding frame assembly.

6. The changeable display assembly as claimed in claim 1, wherein said vertically upright channel members include a backwall, laterally opposed sidewalls extending at right angles to the backwall and being reversely bent at terminal ends remote from the backwall to form a narrow vertical slot receiving the side edges of the placard assembly, a pair of vertical elongated strips extending from said backwall, parallel to the sidewalls of said vertical upright channel members, and defining with the sidewalls, a pair of vertical slots, the upper ends of said vertically upright channel members being obliquely cut to form mitered ends, said display assembly further including a top channel member of a length equal to the distance between the backwalls of said laterally opposed vertically upright facing channel members, said top channel member being of U-shaped cross-section including laterally spaced sidewalls, said sidewalls terminating at their ends in oblique mitered edges matching the ends of the vertically upright facing channel member and an open slot facing downwardly for receiving the upper edge of the placard assembly, said top channel member further comprising a pair of laterally spaced prongs at respective ends sized to the slots between the vertical strips and the sidewalls of said vertically upright facing channel members and being received therein such that the top channel member extrusion is frictionally locked to the vertically upright facing channel member ends with said placard assembly captured between and fitted about its edges to the horizontal placard support channel member, the laterally opposed, vertically upright facing channel members and the top channel member to form a four-part right angle frame of significant strength and rigidity while permitting ready replacement of the placard assembly captured and held thereby.

* * * * *